US007827999B2

(12) United States Patent
Tu

(10) Patent No.: US 7,827,999 B2
(45) Date of Patent: Nov. 9, 2010

(54) BOBBY PIN

(75) Inventor: Jui-Ming Tu, Tainan (TW)

(73) Assignee: Tsorng Ta Enterprise Co., Ltd., Tainan (TW)

( * ) Notice: Subject to any disclaimer, the term of this patent is extended or adjusted under 35 U.S.C. 154(b) by 561 days.

(21) Appl. No.: 11/933,870

(22) Filed: Nov. 1, 2007

(65) Prior Publication Data

US 2009/0114241 A1 May 7, 2009

(51) Int. Cl.
*A45D 8/00* (2006.01)
*A45D 8/22* (2006.01)

(52) U.S. Cl. ..... 132/277; 132/276

(58) Field of Classification Search ..... 132/276–279, 132/280–284; D28/39–41
See application file for complete search history.

(56) References Cited

U.S. PATENT DOCUMENTS 959,712 A * 5/1910 Burke ..... 132/279
2009/0194131 A1* 8/2009 Kim ..... 132/277
2009/0229626 A1* 9/2009 Hsu ..... 132/277

* cited by examiner

*Primary Examiner*—Robyn Doan
(74) *Attorney, Agent, or Firm*—J.C. Patents

(57) ABSTRACT

A bobby pin includes a clamping ribs unit and a hair fork. The clamping rib unit consists of a left and a right clamping rib member interspaced, and the left and the right clamping rib member have a press grip with a shaft hole and a guiding groove. The hair fork has two rods extending from a base member. A shaft stands on the base member, extending in the shaft hole of the press grips with a spring fitted around the shaft. In using, a user presses the two press grips to open the left and the right clamping rib member, with the rods of the hair fork shifted and located in the center of the bobby pin. Then the user inserts the left and the right clamping rib member in hair, with the press grips released to permit the left and the right clamping rib member closed up for clamping hair together with the hair fork.

6 Claims, 8 Drawing Sheets

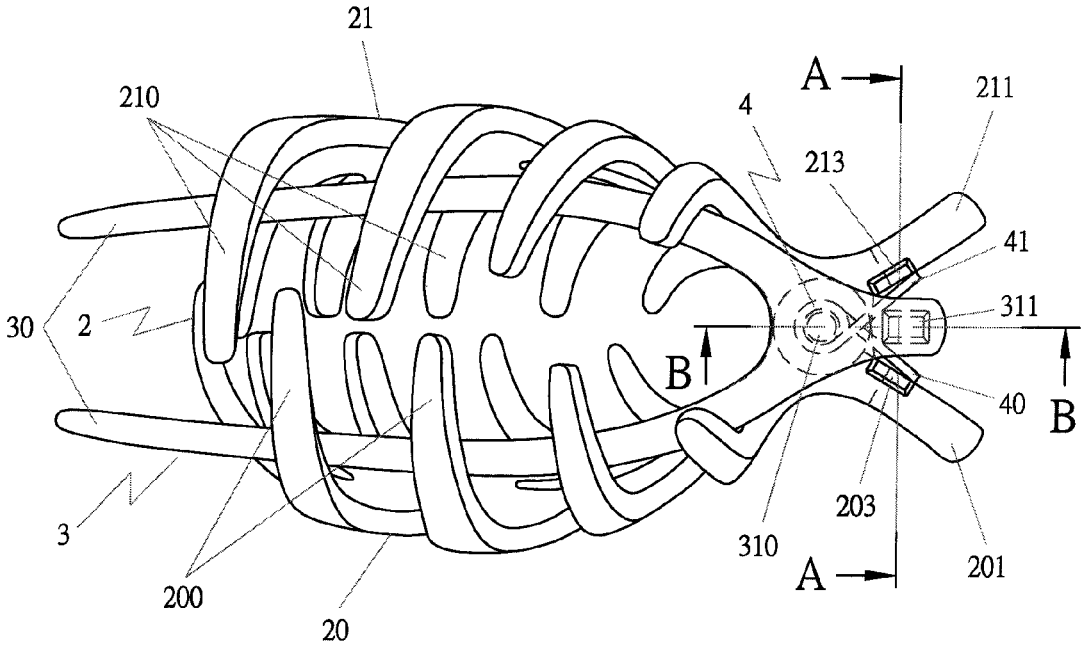
FIG 11
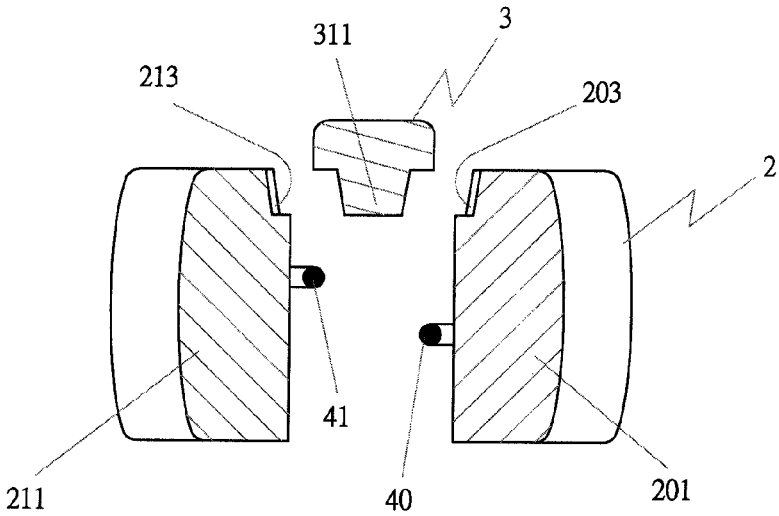
FIG 12 ( A - A )

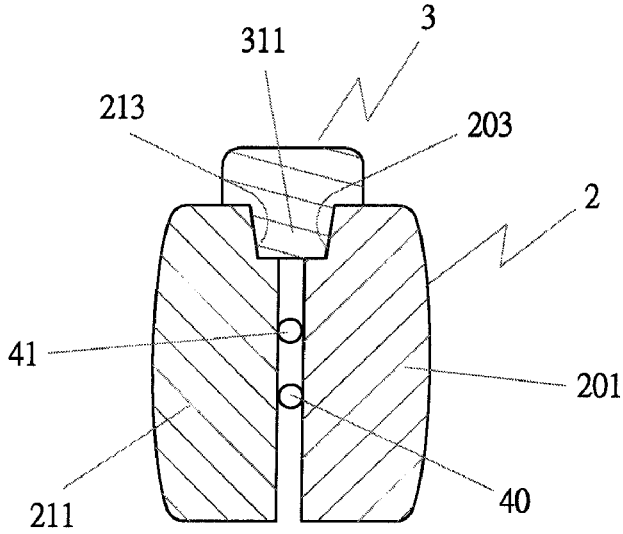
FIG 13
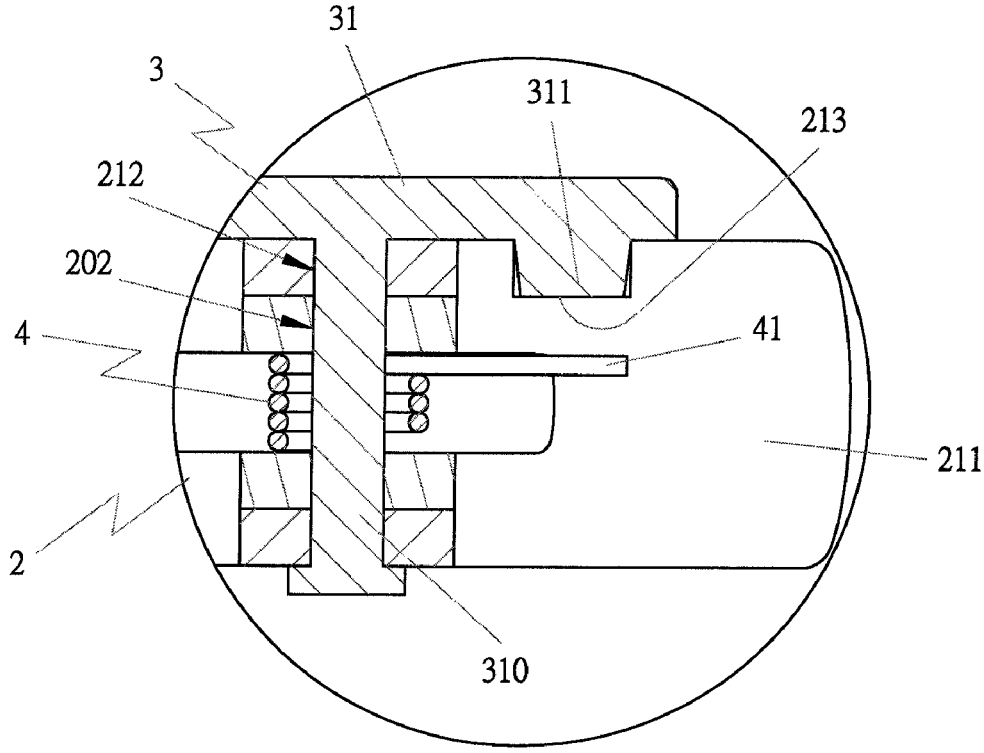
FIG 14 ( B - B )

BOBBY PIN

BACKGROUND OF THE INVENTION

1. Field of the Invention

This invention relates to a bobby pin, particularly to one provided with a clamping rib unit consisting of a left clamping rib member and a right clamping rib member and a press grip formed on the left and the right clamping rib member respectively, so a user can open widely the left and the right clamping member by pushing down the press grips, with a hair fork inserted in the space between the left and the right clamping rib member, and then the left and the right clamping member are closed by releasing the press grips to clamp hair tightly in three-dimension way.

2. Description of the Prior Art

A first conventional bobby pin 10 shown in FIGS. 1 and 2, includes an upper clamping member 100 and a lower clamping member 101, a left and a right press member 102 and 103 formed in a rear portion of the upper and the lower clamping member 100 and 101 respectively. The upper and the lower press member 102 and 103 are respectively provided sidewise with a shaft base 104 and 105 with a hole for a shaft 106 to fit through with a torque spring (not shown) fitted around the shaft 106. Then the first conventional bobby pin can only clamp hair in a line, practically impossible to clamp hair tightly enough, easily to permit hair slip off the bobby pin.

A second convention bobby pin shown in FIGS. 3 and 4 includes a left clamping member 110 and a right clamping member 111, and a left and a right press member 112 and 113 formed respectively on the left and the right clamping member 110 and 111, a shaft base 114 and 115 respectively formed on the left and the right clamping member 110 and 111 for a shaft 116 to fit through and with spring 117 fitted around the shaft 116. From the FIG. 4, it can be seen that hair is clamped between the left and the right clamping member 110 and 111 crossing each other, with a hair fork impossible to be inserted in the bobby pin, resulting in loose clamping to slide off the bobby pin in the same way as the first conventional bobby pin.

Next, a third conventional bobby pin 12 shown in FIGS. 5 and 6 includes an upper clamping member 120 and a lower clamping member 121 almost just like the first conventional bobby pin, but has a larger space between the upper and the lower lamping member 120 and 121 than that of the first conventional one. Thus, the third conventional bobby pin clamps hair in a line too, with the mass of hair clamped more than that by the first conventional one, with hair being apt to slide off the upper and the lower clamping member 120 and 121.

A fourth conventional bobby pin 13 shown in FIGS. 7 and 8 includes an upper and a lower clamping member 130 and 131 nearly the same as the third conventional bobby pin 12, except the dimensions of the upper and the lower clamping member 130 and 131 being larger than that of the third conventional one. So the hair mass clamped between the upper and the lower clamping member 130 and 131 can be much more that of the third conventional one, also impossible to clamp hair in a solid way as the rest conventional bobby pins mentioned above.

SUMMARY OF THE INVENTION

This invention has been devised to offer a kind of bobby pin, possible to clamp hair tightly in a three-dimension way and have an ornamental effect, with the following features.

1. It consists of a left and a right clamping rib member respectively having a plurality of curved ribs arranged to fit in a space between every two ribs mutually, when the left and the right clamping rib member are closed together for clamping hair.
2. It is provided with a hair fork to be positioned in the center of a space between the left and the right clamping rib member for reinforcing clamping function.
3. The left and the right clamping rib member respectively have a press grip, and a user pushes down the press grips to open the left and the right clamping unit, with a guiding groove in the press grips clamping a correct rod of the hair fork to adjust the hair fork just positioned in the center of the space between the left and the right clamping unit. Then the left and the right clamping unit are closed to clamp hair quite tightly with cooperation of the hair fork and the bobby pin can have a decorative effect.

BRIEF DESCRIPTION OF DRAWINGS

This invention will be better understood by referring to the accompanying drawings, wherein:

FIG. 11 is an upper view of the bobby pin in the present invention;

FIG. 12 is a partial cross-sectional view of a left and a right clamping unit opened in the present invention;

FIG. 13 is a partial cross-sectional view of the left and the right clamping unit in the present invention;

FIG. 14 is a partial cross-sectional view of the line B-B in FIG. 11;

DETAILED DESCRIPTION OF THE PREFERRED EMBODIMENT

Figure 1:
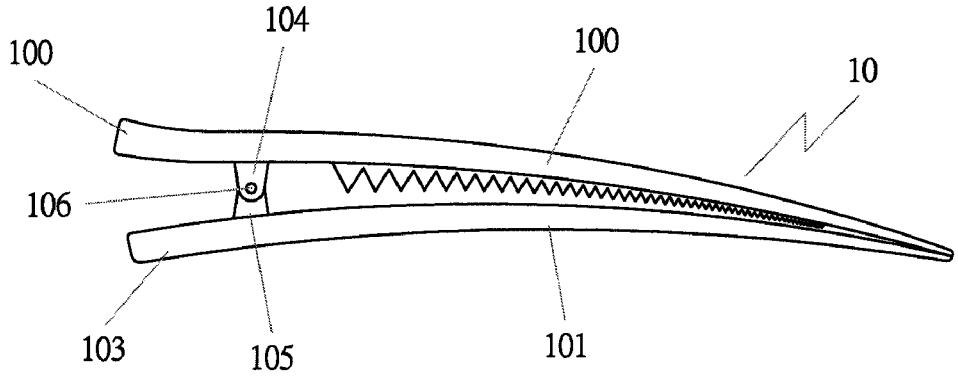
FIG 1 ( PRIOR ART )
FIG. 1 is a side view of a first conventional bobby pin.
Figure 2:
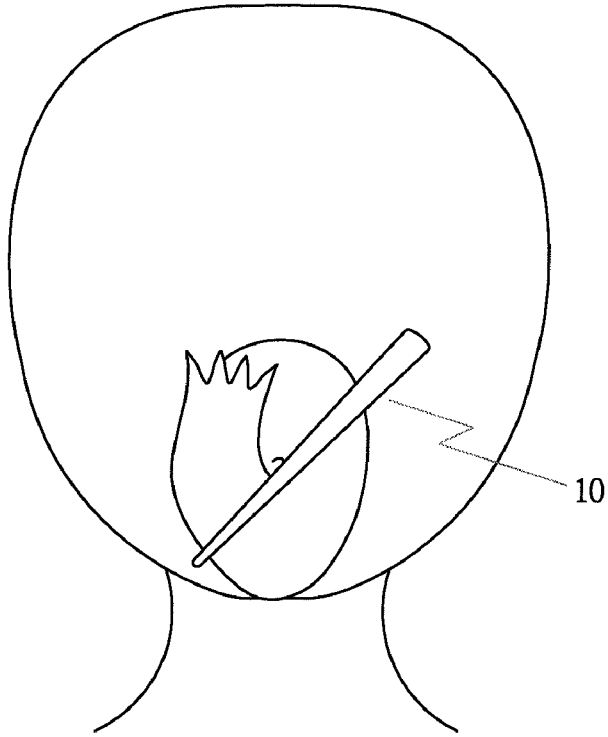
FIG 2 ( PRIOR ART )
FIG. 2 is a perspective view of the first conventional bobby pin clamping hair.
Figure 3:
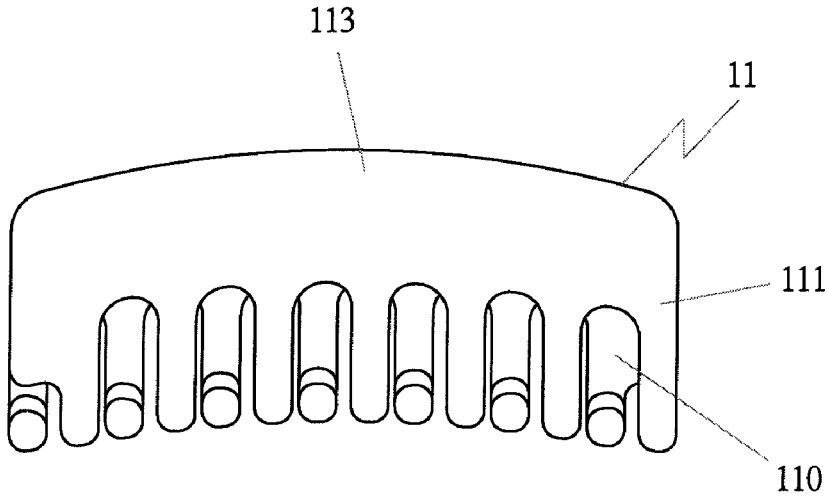
FIG 3 ( PRIOR ART )
FIG. 3 is a side view of a second conventional bobby pin.
Figure 4:
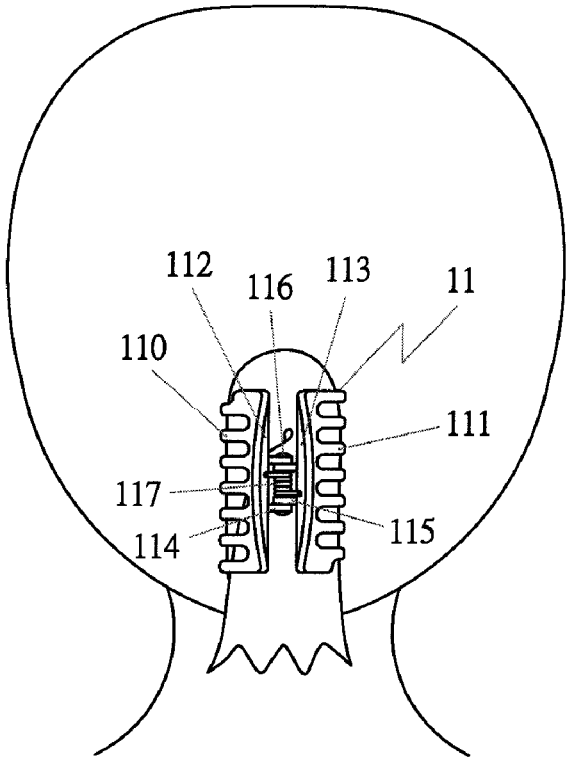
FIG 4 ( PRIOR ART )
FIG. 4 is a side view of the second conventional bobby pin clamping hair.
Figure 5:
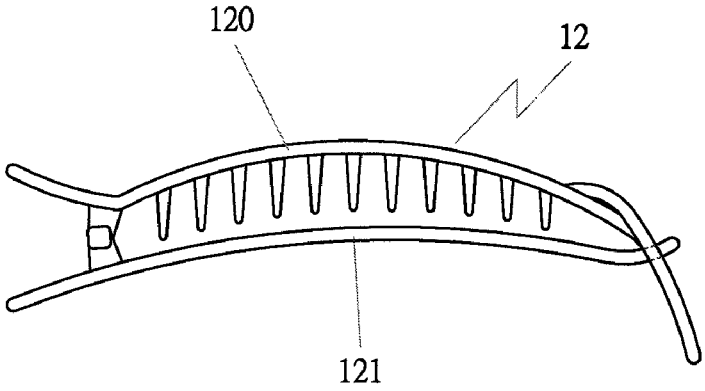
FIG 5 ( PRIOR ART )
FIG. 5 is a side view of a third conventional bobby pin.
Figure 6:
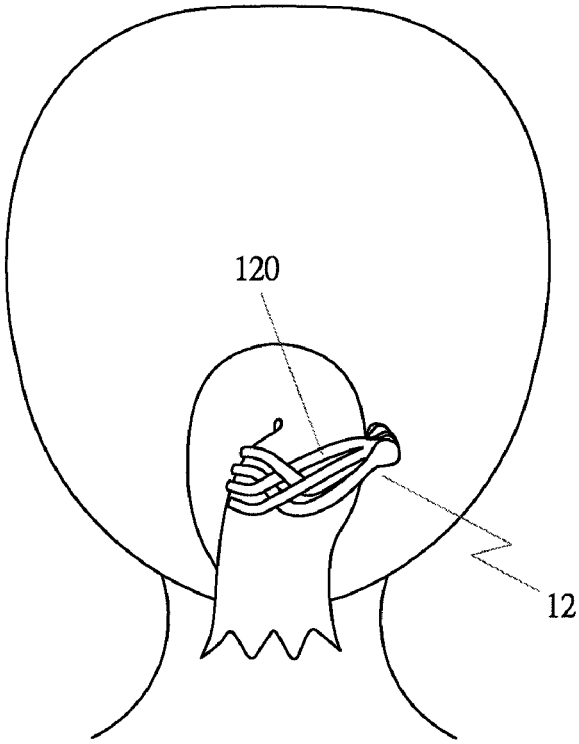
FIG 6 ( PRIOR ART )
FIG. 6 is a perspective view of the third conventional bobby pin.
Figure 7:
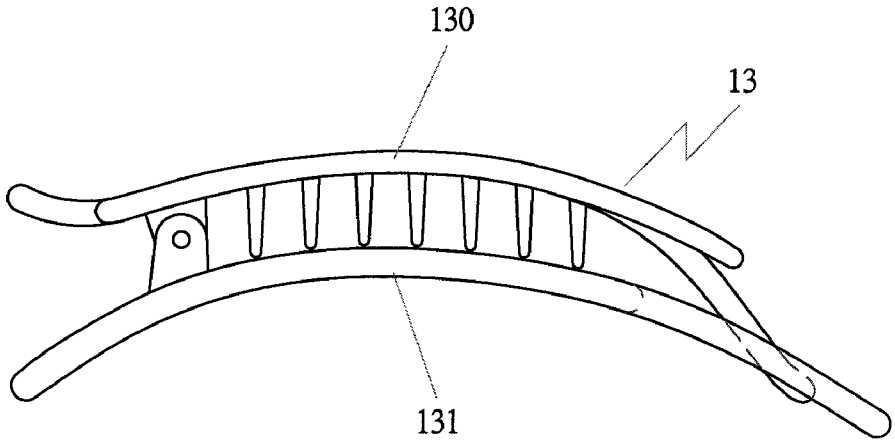
FIG 7 ( PRIOR ART )
FIG. 7 is a side view of a fourth conventional bobby pin.
Figure 8:
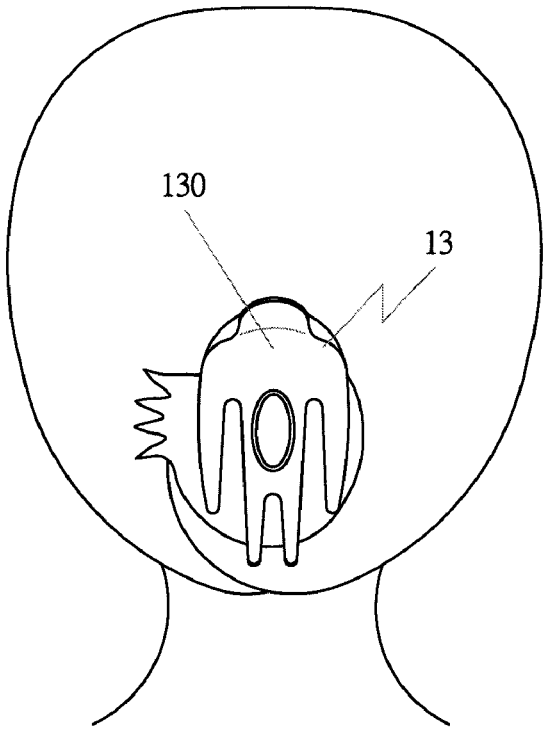
FIG 8 ( PRIOR ART )
FIG. 8 is a side view of the fourth conventional bobby pin clamping hair.
Figure 9:
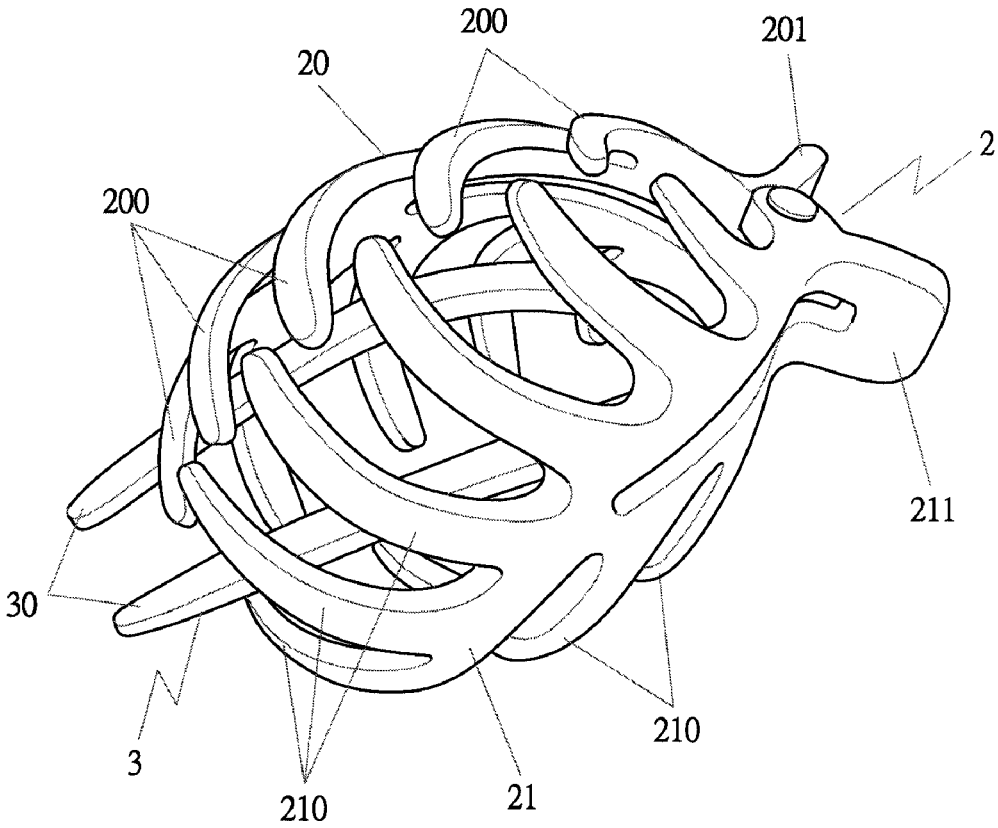
FIG. 9 is a perspective view of a bobby pin in the present invention.
Figure 10:
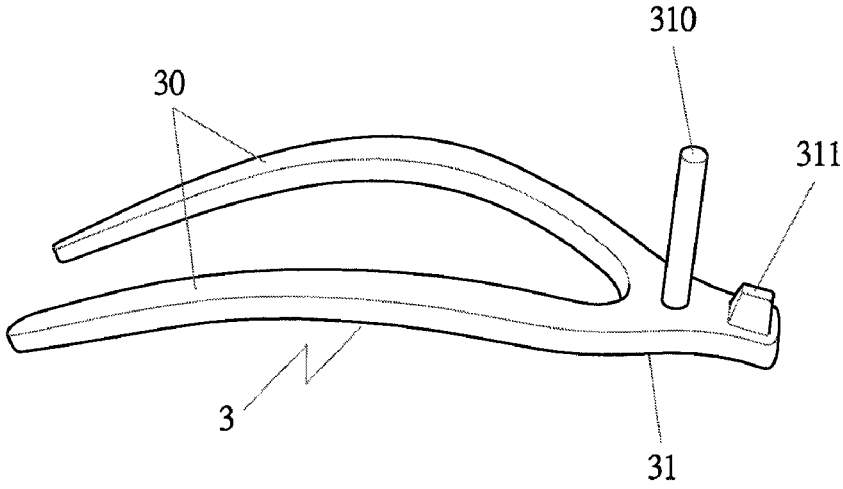
FIG. 10 is a perspective view of a hair fork in the present invention.

A preferred embodiment of a bobby pin in the present invention, as shown in FIGS. 9, 10 and 11, includes a clamping rib unit 2 and a hair fork 3.

Figure 15:
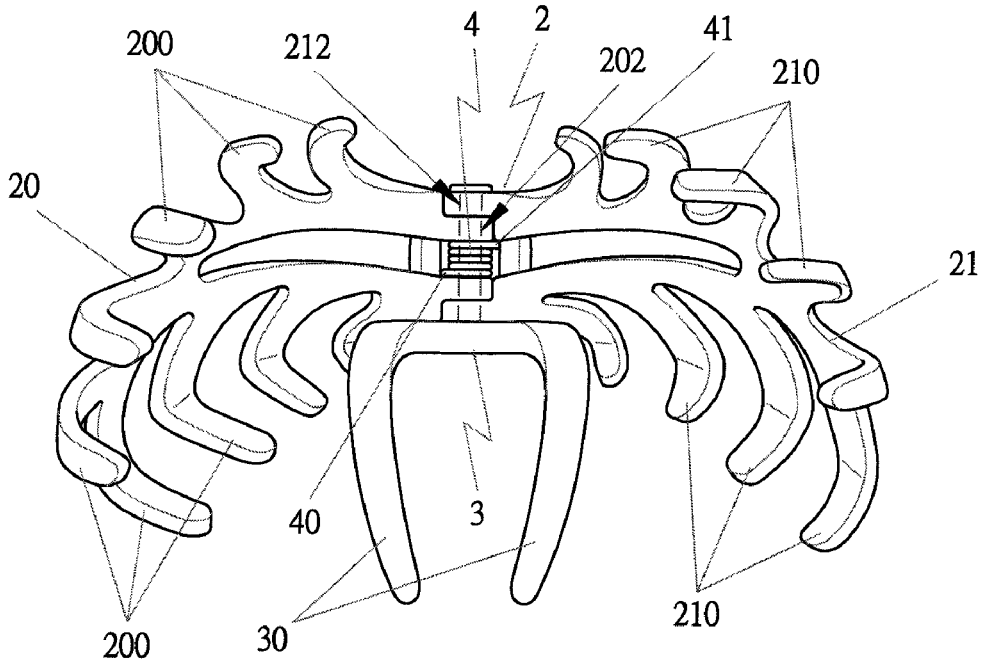
FIG. 15 is a front view of the bobby pin closed up in the present invention; and, FIG. 16 is a side view of the bobby pin clamping hair in the present invention.

The clamping rib unit 2 is composed of a left clamping rib member 20 and a right clamping rib member 21, and the left and the right clamping member 20 and 21 respectively have a plurality of curved ribs 200 and 210 arranged spaced apart in such a way that each rib 200 of the left clamping rib member 20 insert in a gap between every two adjacent ribs 210 of the right clamping rib member 201 when they are closed. Further the left and the right clamping rib member 20 and 21 are respectively provided with a press grip 201 and 211 formed symmetrically in an end, and a shaft hole 202 and 212 are respectively formed in the press grip 201 and 211 respectively as shown in FIG. 15. Further, the press grips 201 and 211 have a correct groove 203 and 213 respectively in an inner surface as shown in FIGS. 12, 13 and 14.

The hair fork 3 is provided with two rods spaced apart 30 and a base member 31. The rods 30 extend out from the base member 31, and a shaft 310 is formed integral to stand upright on the base member 31, fitting in the shaft holes 202 and 212 of the press grips 201 and 211, as shown in FIGS. 14 and 15, with a spring 4 fitting around the shaft 310. The spring 4 is preferably a torque one, having two ends 40 and 41 extending to push against the inner surface of the press grips 201 and 211 so that the left and the right clamping rib member 20 and 21 can elastically and automatically be pushed back to close after opened. Then the bobby pin 10 can maintain clamping function with ease. In addition, the base member 31 has a correct block 311 sidewise on the rear end. So when a user presses down the press grids 201 and 211 to force the left and the right clamping rib member 20 and 21 open, the correct grooves 203 and 213 can clamp the correct block 311 therein, so that the hair fork 3 can be adjusted to position just in the center of the space between the left and the right clamping rib member 20 and 21, as shown in FIG. 15.

Figure 16:
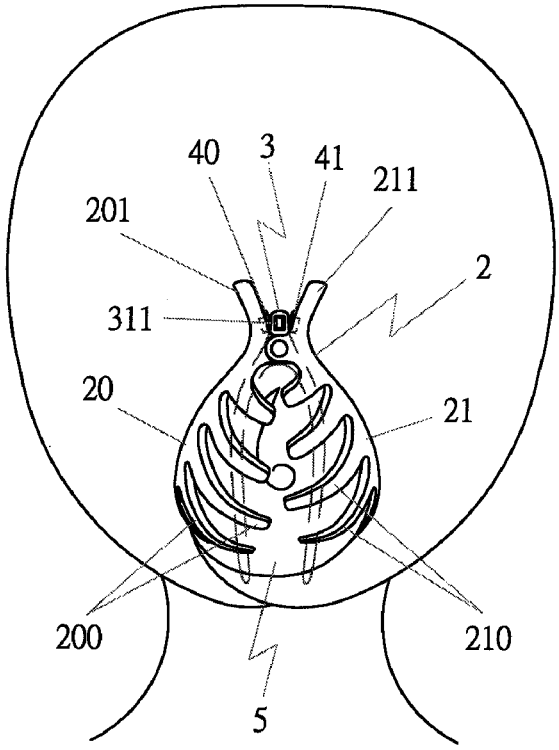

In handling the bobby pin 10, a user first inserts the hair fork 3 in a topknot 5 as shown In FIG. 16, and then the curved ribs 200 and 210 of the left and the right clamping rib member 20 and 21 are opened by pressing the press grips 201, 211, moved into hair, and then released the press grips 201 and 211 to let the two clamping rib member 20 and 21 to close and clamp hair, with the hair fork 3 extending in the hair near the head skin. Then the hair can tightly be clamped in three dimensions in a solid way, as shown in FIG. 16.

While the preferred embodiment of the invention has been described above, it will be recognized and understood that various modifications may be made therein and the appended claims are intended to cover all such modifications that may fall within the spirit and scope of the invention.

What is claimed is:

1. A bobby pin comprising:

a clamping rib unit consisting of a left clamping rib member and a right clamping rib member, said left and right clamping rib members having a plurality of curved ribs apace apart properly, each of said left and right clamping rib members respectively provided with a press grip formed in one end, said press grip bored with a shaft hole and formed with a correct groove in an inner surface; and a hair fork having a rod and a base member, said rod extending out from said base member, said base member having a shaft standing upright sidewise, said shaft extending in said shaft hole of said press grip of said left and right clamping rib members, a spring fitting around said shaft, said base member provided with a correct block.

2. The bobby pin as claimed in claim 1, wherein said curved ribs of said left and right clamping rib members respectively fit in a space between every two adjacent ribs of an opposite clamping rib member when said left and right clamping rib members are closed up.

3. The bobby pin as claimed in claim 1, wherein two rods extend spaced apart out of said base member.

4. The bobby pin as claimed in claim 1, wherein said shaft of said base member of said hair fork is integrally formed with said hair fork.

5. The bobby pin as claimed in claim 1, wherein two ends of said spring respectively extend to push against an inner surface of said press grip of said left and right clamping rib members.

6. A bobby pin comprising:

a clamping rib unit consisting of a left clamping rib member and a right clamping rib member, said left and left clamping rib members respectively having a plurality of curved ribs, each of said left and right clamping rib members respectively having a press grip formed in one end, each said press grip having a shaft hole, a hair fork formed inside said clamping rib unit and having a rod member and a base member, said base member of said hair fork provided with a shaft, said shaft extending in said shaft hole of said left and right clamping rib members; and said hair fork moving together with said left and right clamping rib members when said left and right clamping rib members are opened out so that said hair fork may be corrected to position just in a center of a space between said left and right clamping rib members, said hair fork and said left and right clamping rib members clamping hair together at the same time in a tightly three-dimensional way.

* * * * *